US006408614B1

(12) United States Patent
Eizenhöfer

(10) Patent No.: US 6,408,614 B1
(45) Date of Patent: Jun. 25, 2002

(54) HIGH-POWER PRESSURE WAVE SOURCE

(75) Inventor: Harald Eizenhöfer, Seefeld (DE)

(73) Assignee: Dornier Medizintechnik GmbH, Wessling (DE)

( * ) Notice: Subject to any disclaimer, the term of this patent is extended or adjusted under 35 U.S.C. 154(b) by 0 days.

(21) Appl. No.: 09/037,952

(22) Filed: Mar. 10, 1998

(30) Foreign Application Priority Data

Mar. 11, 1997 (DE) ..... 197 09 918

(51) Int. Cl.[7] ..... F02K 7/02; F23R 7/00

(52) U.S. Cl. ..... 60/200.1; 60/247; 116/23; 181/116; 340/385.1; 367/145

(58) Field of Search ..... 60/39.76, 39.77, 60/39.78, 200.1, 247, 248, 249; 116/23; 181/116, 117, 118; 340/385.1; 367/145; 431/1

(56) References Cited

U.S. PATENT DOCUMENTS 3,249,177 A * 5/1966 Chelminski ..... 181/118
3,588,801 A * 6/1971 Leonard ..... 340/12
4,189,026 A * 2/1980 Elliot et al. ..... 181/118
4,642,611 A * 2/1987 Koerner ..... 340/385
5,864,517 A * 1/1999 Hinkey et al. ..... 367/145

FOREIGN PATENT DOCUMENTS

DE 3921808 A1 1/1991

OTHER PUBLICATIONS

Breitung et al. 1996, Numerische Simulation von turbulenten . . . *Nachrichten–Forschungszentrum Karlsruhe.*

* cited by examiner

*Primary Examiner*—Louis J. Casaregola
(74) *Attorney, Agent, or Firm*—King & Spalding

(57) ABSTRACT

High-power pressure wave source for generating pressure waves that can be repeated by igniting a combustible fluid mixture and by increasing its rate of combustion up to detonation. The high-performance pressure wave source has a channel, which expands toward one of its ends and forms a combustion chamber, a feed means for the components of the fluid mixture, and an igniting means in the area of the narrow end of the channel, a discharge means for the waste gas in the area of the wide end of the channel, and a membrane closing the wide end of the channel on the front side, as well as a plurality of vortex generators distributed over the length of the channel.

9 Claims, 1 Drawing Sheet

1

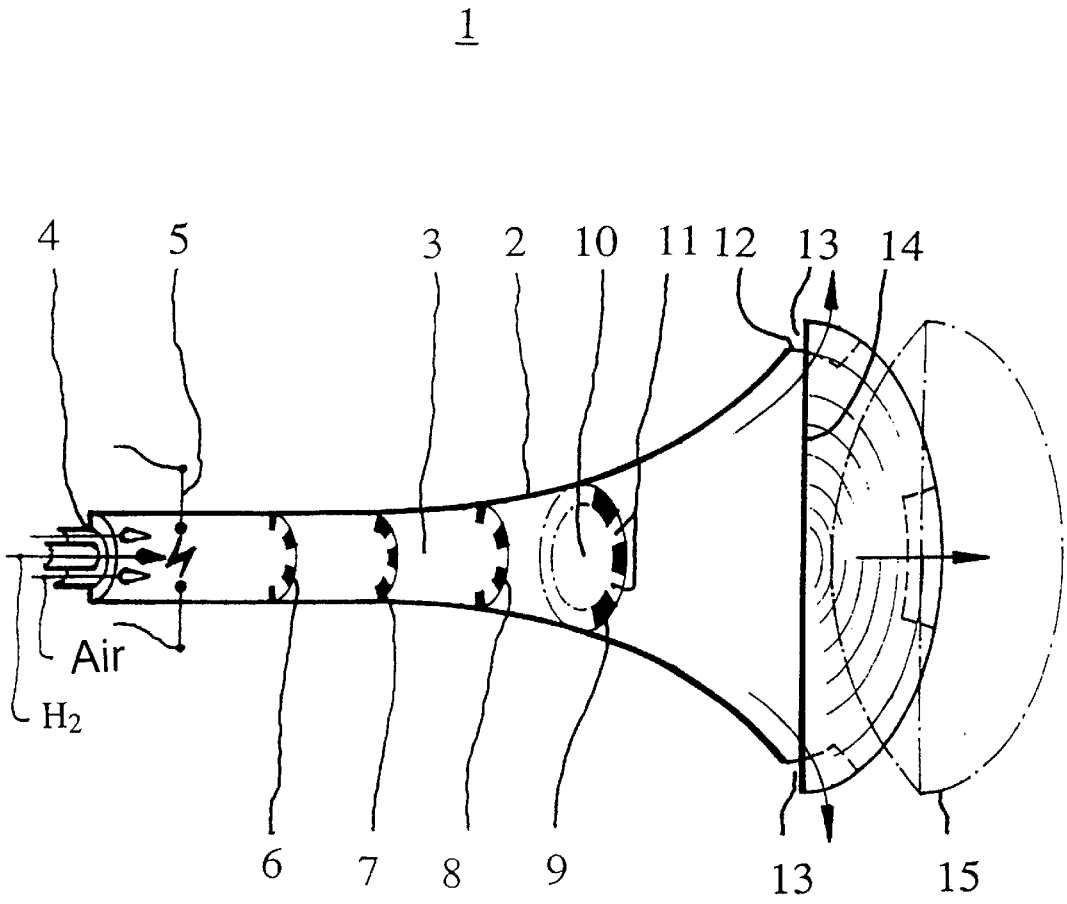
1
4
5
3
2
10
11
12
13
14
Air
$H_2$
6
7
8
9
13
15

HIGH-POWER PRESSURE WAVE SOURCE

FIELD OF THE INVENTION

The present invention pertains to a high-power pressure wave source for generating individual, high-energy pressure waves that can be repeated at short intervals of time, each time by igniting a defined volume of a combustible fluid mixture as well as by increasing its rate of combustion up to detonation.

BACKGROUND OF THE INVENTION

Pressure and shock waves of relatively low power (about 10 to 100 mJ) have been known especially from medical engineering, e.g., in the form of lithotriptors. Current versions usually operate according to the electromagnetic principle, generating flat, focusable pressure waves by means of a coil/membrane unit.

For nonmedical, especially industrial applications, there is a need for a substantially higher pressure wave energy (about 50 to 100 times higher energy). A simple enlargement/scale-up of the prior-art electromagnetic shock wave sources is not meaningful because of their poor efficiency.

DE-OS 39 21 808 discloses a device for the focused shock wave treatment of tumors, with various possibilities of shock wave generation, e.g., by means of an explosive gas mixture (see claim 10). However, no indications of the design embodiment of this principle are given.

Pressure waves are also generated in reciprocating piston motors by the ignition of combustible fluid mixtures, and the ignition process can be repeated at short intervals of time as often as desired. The fluid mixture, at least the air component, is greatly compressed (factor >10), and the combustion is initiated by electric spark ignition or by injecting the fuel. A "soft," not too rapid combustion is generally desired, because detonation-like combustion processes would mechanically overload the components of the motor (pistons, connecting rod, bearings, etc.). The transmission of this principle of compression to other pressure wave sources would be relatively complicated in terms of design and energy, i.e., rather uneconomical.

It has been known that hydrogen-air mixtures can be ignited under atmospheric pressure and that the initially slow, laminar combustion (deflagration) can be accelerated by slightly increasing the pressure by fluidic measures (vortex generators/flow obstacles) via a rapid, turbulent combustion up to the detonation with high pressure peaks. This principle is utilized in experimental techniques to simulate the conditions and loads possibly occurring in the reactor building during nuclear power plant accidents (core melt-through, release of hydrogen). See the journal "NACHRICHTEN" *Forschungszentrum Karlsruhe,* Vol. 28 (1996), No. 2–3, pp. 175–191. Large, tubular or channel-like combustion chambers with lengths of 12 m and 70 m and with variable, fluidically effective built-in units/geometries were built for this purpose, the smaller unit (FZK) being in Germany and the larger (RUTT) in Russia.

SUMMARY AND OBJECTS OF THE INVENTION

Based on the principle of combustion acceleration to detonation, which was embodied in large dimensions there, the primary object of the present invention is to provide a high-power pressure wave source with short pulse duration and good repetition rate, which is relatively simple, manageable, robust and inexpensive and operates safely, reliably, and economically.

According to the invention, a high-power pressure wave source for generating individual, high-energy pressure waves is provided. The generation of the waves can be repeated at short intervals of time, each time by igniting a defined volume of a combustible fluid mixture as well as by increasing its rate of combustion up to detonation. A channel of a defined length, which expands in cross section toward one of its two ends is provided to form a combustion chamber. A feed means is provided for the components of the fluid mixture, and an igniting means is provided in the area of the narrow end of the channel. A discharge means is provided for the waste gas in the area of the second end of the channel, and a said membrane is provided which closes the wide end of the channel on the front side and forms an acoustic transmission element. Further, a plurality of vortex generators are distributed over the length of the channel.

The pressure wave source comprises a combustion chamber in the form of a channel of a defined length with an end of enlarged cross section. The front-side closure of the wide channel end forms a membrane acting as an acoustic transmission element, wherein a discharge means for the waste gas is present in the area of the membrane. The narrow channel end is used to feed the components of the mixture and for ignition. The vortex generators, which accelerate the combustion process up to the detonation, are provided between the narrow and wide ends of the channel. It is achieved due to the geometric/volumetric conditions that the majority of the mixture is located in the area of the membrane, burns off there in a detonation-like manner, and thus brings about the pressure wave generation. Any desired, acoustically conductive medium (e.g., solid, gel-like, rubber-like) may be in contact with the membrane during use. Elements for focusing the pressure waves originating from the membrane may be joined as well.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWING

In the drawings:

The only FIGURE is a schematic perspective view of a central longitudinal section of a high-power pressure wave source according to the invention.

DESCRIPTION OF THE PREFERRED EMBODIMENT

Referring to the drawing in particular, the only figure shows in a greatly simplified, perspective view, with the direction of view from right to left at an acute angle toward the plane of the drawing, a central longitudinal section of a high-power pressure wave source 1.

The high-power pressure wave source 1, hereinafter called pressure wave source 1 for simplicity's sake, consists, for the most part, of a pipe 2 with round cross section varying over the length, which forms both a supporting housing and a flow channel/combustion chamber 3. The flow is from left to right, i.e., from the narrow end of the pipe to the end of the pipe expanded in a trumpet-like manner. The narrow pipe end is provided with a feed means 4 for the components of a combustible fluid mixture, here air and hydrogen ($H_2$), wherein the feed may be continuous or intermittent during the operation. The coaxial admission of the components shown in the longitudinal direction of the pipe appears to be advantageous, but it is only one of many conceivable variants of admission. What is important in any case is that the most possibly homogeneous fluid mixture be generated rapidly and over a short path. The fluid mixture consists of at least one fuel and one oxidant, and the combustion behavior can be influenced by varying the mixing ratio, i.e., the deviation from the stoichiometric ratio. In view of complete combustion, the setting should tend toward the "lean" side. Mixtures consisting of more than two components are also conceivable, e.g., to influence the combustion behavior, the waste gas composition, or the thermal load.

The igniting means 5 operates intermittently, and a high rate of repetition (1 Hz or higher) is desirable. An electric spark ignition appears to be most advantageous here. Rapid glow ignition may also satisfy the needs.

Only a very low rate of combustion of, e.g., 0.15 m/sec, which is not yet able to generate usable pressure waves, can be initially generated with a moderate, i.e., economical ignition energy. The necessary acceleration of combustion is achieved by means of a plurality of vortex generators 6 through 9, i.e., with an increasingly turbulent character. The rate of combustion can thus be increased to values far above 1,000 m/sec with short, high pressure peaks (detonation). The vortex generators 6 through 9 are designed in this case as, e.g., apertured diaphragms with "tooth gaps" up to the pipe wall. This can be recognized most clearly in the vortex generator 9, whose central opening 10 expands locally in the form of a plurality of gaps 11 to the pipe wall. The smallest and largest diameters of the vortex generator 9 are additionally indicated by dash-dotted lines.

The optimal number and the geometry of the vortex generators are foreseeably to be determined experimentally. After passing through the last vortex generator, the combustion should always have the character of a detonation.

The cross section distribution and consequently the volume distribution within the combustion chamber 3 is selected to be such that a large percentage of the fluid mixture burns in a detonation-like manner, i.e., is located behind the "flame acceleration zone."

The trumpet-like shape shown with a continuous expansion of the cross section, e.g., according to an exponential function, may be advantageous, e.g., with respect to the propagation of the pressure wave. However, other wall contours are also conceivable, e.g., with breaks and step-like jumps in diameter. It may be sufficient to connect two cylindrical pipe sections with greatly different diameters via an apertured diaphragm-like wall jump in diameter). Conical or multiply stepped transitions may be used as well.

The combustion chamber cross sections need not be round, either. Square, rectangular or other geometries with or without corners are conceivable.

It would be possible to modify the "pressure wave trumpet" shown by the use of square rather than round cross sections, while maintaining the continuous, exponential expansion of the cross section to a "pressure wave horn." Finally, it is important that a large part of the volume of the combustion chamber burns in a detonation-like manner, and that this volume part is located in the area of a membrane 14 limiting the combustion chamber on the front side. The ignition process and the flame acceleration process shall be limited to a volumetrically small part of the combustion chamber. The combustion chamber is filled with a combustible fluid mixture, i.e., rinsed before each ignition process.

A discharge means 12, here in the form of a plurality of discharge slots 13 distributed over the circumference, is provided in the area of the membrane 14 for the waste gases generated during the combustion. The discharge process should not possibly cause any lateral reaction forces on the pressure wave source 1. Instead of the discharge slots 13, it is also possible to use flaps, valves or other discharge members.

If unburned residual amounts of fuel are contained in the waste gas, a specific afterburning may be meaningful or necessary. The membrane 14 closing the combustion chamber 3 on the front side has both a separating and transmitting function. On the one hand, it protects the substance present in the adjoining area from the direct effects of the combustion process (heat, combustion products, etc.); on the other hand, it forms a low-loss acoustic transmission element for the shock waves generated. Either the substance is to be processed directly in physical contact with the membrane 14, or at least one additional transmission medium, e.g., gel, water, or rubber, is inserted between the membrane and the substance. The latter, indirect contacting is especially indicated if the pressure waves generated are focused after the membrane.

A focusing means 15 in the form of an acoustic lens is indicated by dash-dotted lines in this example. Details are not shown for clarity's sake. The focusing means 15 or additional focusing means are detachably connected as attached elements to the pressure wave source 1, which has corresponding connection possibilities, only when needed.

Concerning the possible applications of the present invention, it can be stated that their actual scope is not foreseeable. Most substances, ranging from solid to gaseous, can be foreseeably treated. Liquids mixed with solids, dusts, powders, and granules may be mentioned, in particular. The conceivable effects are, e.g., homogenization, size reduction, the elimination of voids, or other "defects," the dissolution of deposits, incrustations, etc., and thus the cleaning of surfaces and many more.

While a specific embodiment of the invention has been shown and described in detail to illustrate the application of the principles of the invention, it will be understood that the invention may be embodied otherwise without departing from such principles.

LIST OF REFERENCE NUMBERS

1 High-power pressure wave source
2 Pipe
3 Combustion chamber
4 Feed means
5 Igniting means
6 Vortex generator
7 "
8 "
9 "
10 Opening
11 Gap
12 Discharge means
13 Discharge slot
14 Membrane
15 Focusing means

What is claimed is:

1. A high-power pressure wave source for generating individual, high-energy pressure waves that can be repeated at short intervals of time, each time by igniting a defined volume of a combustible fluid mixture as well as by increasing its rate of combustion up to detonation, the pressure wave source comprising:

a channel of a defined length, which expands in cross section toward one of its two ends and forms a combustion chamber, one of said two ends being a narrow end and the other of said two ends being a wide end;

a feed means for feeding components of the fluid mixture;

an igniting means, in the area of the narrow end of the channel, for igniting the fluid mixture;

a discharge means for the waste gas in the area of said wide end of said channel;

a membrane which closes the wide end of the channel on the front side and forms an acoustic transmission element; and a plurality of vortex generators distributed over the length of the channel.

2. The high-power pressure wave source in accordance with claim 1, wherein the fluid mixture is a lean to stoichiometric hydrogen-air mixture.

3. The high-power pressure wave source in accordance with claim 1, wherein said combustion chamber is a pipe expanded continuously, in a trumpet-shaped manner, toward said membrane.

4. The high-power pressure wave source in accordance claim 1, wherein said igniting means includes an electric spark ignition.

5. The high-power pressure wave source in accordance with claim 1, wherein said discharge means is in the form of a plurality of discharge slots provided in an area of an edge of said membrane.

6. The high-power pressure wave source in accordance with claim 1, wherein said vortex generators are formed of diaphragm-like structures with a central opening and a plurality of tooth gap-like openings forming a continuation of said central opening in some areas into the area of the channel wall.

7. The high-power pressure wave source in accordance with claim 3, wherein said channel has a tubular geometry, in which a diameter increases exponentially in relation to the longitudinal coordinate of the channel, at least in the vicinity of said membrane.

8. The high-power pressure wave source in accordance with claim 1, wherein the pulse duration of the individual pressure wave generated is less than 100 $\mu$sec and with a repetition rate of at least 1 Hz.

9. The high-power pressure wave source in accordance with claim 1, further comprising an acoustic focusing means arranged downstream of said membrane.

* * * * *